US009738498B2

(12) United States Patent
Kawabuchi et al.

(10) Patent No.: US 9,738,498 B2
(45) Date of Patent: Aug. 22, 2017

(54) TELESCOPIC BOOM EXTENSION DEVICE

(71) Applicant: TADANO LTD., Kagawa (JP)

(72) Inventors: Naoto Kawabuchi, Sanuki (JP); Takashi Kawano, Sanuki (JP)

(73) Assignee: TADANO, LTD., Takamatsu-shi, Kanagawa (JP)

( * ) Notice: Subject to any disclaimer, the term of this patent is extended or adjusted under 35 U.S.C. 154(b) by 11 days.

(21) Appl. No.: 15/010,078

(22) Filed: Jan. 29, 2016

(65) Prior Publication Data

US 2016/0221803 A1 Aug. 4, 2016

(30) Foreign Application Priority Data

Feb. 4, 2015 (JP) ..... 2015-019898

(51) Int. Cl.
*E04H 12/18* (2006.01)
*E04H 12/34* (2006.01)
*B66C 23/70* (2006.01)

(52) U.S. Cl.
CPC ..... *B66C 23/705* (2013.01)

(58) Field of Classification Search
CPC ..... B66C 23/705
USPC ..... 52/115, 118
See application file for complete search history.

(56) References Cited

U.S. PATENT DOCUMENTS 2,833,422 A * 5/1958 Ferwerda ..... E02F 3/286 212/349
3,624,979 A * 12/1971 Przybylski ..... B66C 23/705 212/231
4,459,786 A * 7/1984 Pitman ..... B66C 23/701 212/348
4,478,014 A * 10/1984 Poock ..... B66C 23/701 212/350
4,663,900 A * 5/1987 Rehm ..... H01Q 1/10 212/292
4,676,340 A * 6/1987 Correll, Jr. ..... B66F 11/046 182/2.11
4,688,690 A * 8/1987 Gattu ..... B66C 23/708 212/292
5,628,416 A 5/1997 Frommelt et al.
7,497,140 B2 * 3/2009 Blackwelder ..... F16H 25/20 52/118

FOREIGN PATENT DOCUMENTS

JP H7-267584 A 10/1995
JP 4612144 B 1/2011
JP 4709415 B 6/2011

* cited by examiner

*Primary Examiner* — Charles A. Fox
*Assistant Examiner* — James Buckle, Jr.
(74) *Attorney, Agent, or Firm* — Brundidge & Stanger, P.C.

(57) ABSTRACT

A telescopic boom extension device includes a cylinder-boom coupling mechanism, an inter-boom fixing mechanism, and a driving mechanism that drives the foregoing two. The driving mechanism has a hydraulic supply part and a drive source generation part. The hydraulic supply part includes an AOH and is provided at a cylinder tube of a telescopic boom. The hydraulic supply part supplies operating oil selectively to actuators driving a B pin and a C pin. The drive source generation part includes an air hose and supplies compressed air to the AOH. The air hose is wound around a hose reel in an unrollable manner.

4 Claims, 7 Drawing Sheets

TELESCOPIC BOOM EXTENSION DEVICE

CROSS-REFERENCE TO RELATED APPLICATIONS

This application is based on and claims the benefit of priority from Japanese Patent Application No. 2015-019898, filed on Feb. 4, 2015, the entire contents of which are incorporated herein by reference.

BACKGROUND OF THE INVENTION

Technical Field

The present invention relates to a telescopic boom extension device for extending and retracting a telescopic boom mounted on a mobile crane.

Related Art

Mobile cranes such as a rough-terrain crane, for example, generally include a multistage telescopic boom. The telescopic boom is extended and retracted using a hydraulic cylinder in general. In particular, devices for extending and retracting a telescopic boom using a single double-acting hydraulic cylinder have been proposed (hereinafter, referred to as "extension device") (for example, refer to JP 7-267584 A, JP No. 4612144, and JP No. 4709415).

The extension device is structured as described below.

The multistage telescopic boom includes bottom-stage and top-stage booms so called the base boom and the top boom, respectively, and one or more booms placed between the foregoing booms, which are so called intermediate booms. When the telescopic boom includes a plurality of intermediate booms, the intermediate boom adjacent to the top boom is referred to as a first intermediate boom, and the other intermediate boom adjacent to the first intermediate boom is referred to as a second intermediate boom while the other intermediate boom adjacent to the second intermediate boom is referred to as a third intermediate boom, and so forth. Each of the booms extends (slides forth) and retracts (slides back) relative to the adjacent boom and is kept by a boom fixing pin (hereinafter, referred to as "B pin") in the fully-retracted state and the fully-extended state. In the telescopic boom, the top boom is extended first, sequentially followed by the intermediate booms.

At the extension device, one end (cylinder rod-side end) of the single hydraulic cylinder is coupled to the base end of the base boom. When the booms are in the fully-retracted state, the adjacent booms are coupled together by the B pins. First, a cylinder tube of the hydraulic cylinder is coupled to the top boom. The two are coupled by a cylinder fixing pin (hereinafter, referred to as "C pin"), and the B pin is removed from between the top boom and the first intermediate boom to allow the top boom to slide relative to the first intermediate boom. When the hydraulic cylinder extends in this state, the top boom extends relative to the first intermediate boom.

When the top boom enters in the fully-extended state relative to the first intermediate boom, the top boom is coupled again to the first intermediate boom by the B pin. The C pin is removed from between the top boom and the hydraulic cylinder to retract the hydraulic cylinder. Then, the hydraulic cylinder is coupled to the first intermediate boom by the C pin, and the B pin is removed from between the first intermediate boom and the second intermediate boom to extend the hydraulic cylinder in this state. Accordingly, the second intermediate boom extends relative to the third intermediate boom. In this manner, each of the booms extends sequentially relative to the adjacent boom, and the entire telescopic boom is finally in the fully-extended state. In the reversed manner, the telescopic boom is retracted.

At a conventional extension device, the B pins and the C pins are driven by a hydraulic actuator. The hydraulic actuator is placed in the vicinity of the cylinder tube of the hydraulic cylinder in general. Accordingly, a pressure oil (operating oil) serving as a drive source for the hydraulic actuator is supplied from a hydraulic pressure source (hydraulic pump) via a hydraulic pipe. As described above, each of the booms slides relative to the adjacent boom, and the pipe for supplying the operating oil is generally a hydraulic pressure hose with a hose reel.

SUMMARY OF THE INVENTION

The length of the telescopic boom varies depending on specifications for a mobile crane. In some cases, the distance from the hydraulic pressure source to the hydraulic actuator is very long. Meanwhile, the assumed environmental temperature during operation of the mobile crane ranges from −20° C. to 90° C. (Celsius). Under low-temperature environments in particular, a rise in the viscosity of the operating oil would cause a problem. That is, an increase in in the viscosity of the operating oil decreases the operating speeds of the B pins and the C pin, thus causing a decrease in responsiveness of the extension and retraction operations of the telescopic boom. This phenomenon is more prominent as the hydraulic pipe is longer.

To avoid such a problem, the capacity of the hydraulic pipe has been increased. Specifically, the hose reel is increased in diameter to reduce flow resistance and/or pressure loss of the operating oil. Taking this measure produces a certain effect (improvement in the operating speeds of the B pins and the C pin) but causes a new problem that the hose reel increases in size, resulting in significant increases in weight and costs. There has been a demand for the mobile crane to reduce the size and weight of auxiliary devices such as a hose reel as much as possible. This demand cannot be met with the larger-sized hose reel.

The present invention has been made under the above-mentioned background. An object of the present invention is to provide a small, lightweight and low-cost telescopic boom extension device capable of smooth driving of the B pins and the C pin even under lower-temperature environments.

(1) A telescopic boom extension device according to an aspect of the present invention includes: a telescopic boom that includes a base boom, an intermediate boom inserted into the base boom, and a top boom inserted into the intermediate boom, one of the booms adjacent to each other being placed slidably relative to the other boom; a single extension cylinder that includes a cylinder tube and a cylinder rod and that is built into the telescopic boom along a longitudinal direction of the booms while the cylinder rod is coupled to the base boom; a cylinder-boom coupling mechanism that includes a first hydraulic actuator configured to engage selectively with the top boom or the intermediate boom to couple the engaged boom to the cylinder tube; an inter-boom fixing mechanism that includes a second hydraulic actuator configured to couple the adjacent booms to regulate relative sliding of the booms and to decouple specific coupled booms when necessary; and a driving mechanism configured to drive the cylinder-boom coupling mechanism and the inter-boom fixing mechanism. This driving mechanism includes: a hydraulic supply part that is provided at the cylinder tube to supply operating oil selectively to the first hydraulic actuator or the second hydraulic actuator; and a drive source generation part that includes a pneumatic supply part configured to supply a pneumatic pressure and that is configured to generate the operating oil under a predetermined pressure at the hydraulic supply part based on the pneumatic pressure.

According to this configuration, the hydraulic supply part configured to drive the cylinder-boom coupling mechanism and the inter-boom fixing mechanism is provided at the cylinder tube of the extension cylinder. Accordingly, the circuit length of the hydraulic supply part becomes very short as compared to the related art, and the reduction in operational responsiveness of the cylinder-boom coupling mechanism and the inter-boom fixing mechanism resulting from a change in the viscosity of the operating oil becomes very small. In addition, the drive source generation part supplies the pneumatic pressure to the hydraulic supply part, and a pneumatic pressure loss with a change in the environmental temperature is small even in a case where the distance between the pneumatic supply part and the hydraulic supply part is long. Thus, the operational responsiveness of the cylinder-boom coupling mechanism and the inter-boom fixing mechanism is not affected even in this case. Therefore, the pneumatic supply part does not need to be increased in size taking into account a pneumatic pressure loss, thereby achieving the lightweight and small part.

(2) It is preferred that the hydraulic supply part include an air over hydraulic booster (AOH), and that the drive source generation part include a pneumatic supply unit connected to the AOH.

According to this configuration, the AOH is employed to ensure that the operating oil under a required pressure (for example, 10 MPa) is supplied in an easy and reliable manner to the first hydraulic actuator or the second hydraulic actuator based on a low-pressure pneumatic source (for example, 1 MPa).

(3) It is preferred that the hydraulic supply part include a pair of the AOHs arranged symmetrically with respect to the cylinder tube.

According to this configuration, the AOHs can be made lightweight and small to facilitate the layout of the AOHs in the boom, and also enable even weight distribution in the boom.

(4) It is preferred that the pneumatic supply unit include: a pneumatic hose configured to connect the pneumatic source and the AOH; and a hose reel.

According to this configuration, a pneumatic unit that has been commonly used is employed in the pneumatic supply unit. Therefore, the pneumatic unit can be configured at low cost. In addition, the pressure loss of the compressed air supplied from the pneumatic unit is unlikely affected by the environmental temperature as described above, so that it is not necessary to employ a large-diameter pneumatic hose taking into account operations under low-temperature environments in particular. Thus, the pneumatic hose and hose reel can be reduced in weight and size.

(5) It is preferred that the AOH include an air cylinder having an air piston and an air tube, and that the air piston be slidable relative to the air tube without being biased in any direction.

Since the hydraulic supply part is provided at the cylinder tube as described above, the AOH generally constitutes a closed circuit as a hydraulic circuit. In such a closed circuit, when the environmental temperature changes to raise the pressure in the operating oil, for example, the air piston is in a freely movable state, so that a piston in the hydraulic cylinder pairing off with the air piston is easily displaceable. That is, making the air piston into the freely movable state would perform the function as if the hydraulic cylinder is provided with a reservoir tank. Therefore, it is not necessary to provide a separate reservoir tank at the AOH, thereby allowing the AOH structure and the hydraulic supply part to be reduced in weight and size.

The present invention provides a small, lightweight and low-cost telescopic boom extension device capable of smooth driving of the cylinder-boom coupling mechanism and the inter-boom fixing mechanism even under low-temperature environments.

DESCRIPTION OF THE EMBODIMENTS

Hereinafter, a preferred embodiment of the present invention will be described with reference as appropriate to the drawings. However, this embodiment is merely one mode of a telescopic boom extension device according to the present invention. As a matter of course, the embodiment can be modified without deviating from the gist of the present invention.

<Schematic Configuration and Features>

Figure 1:
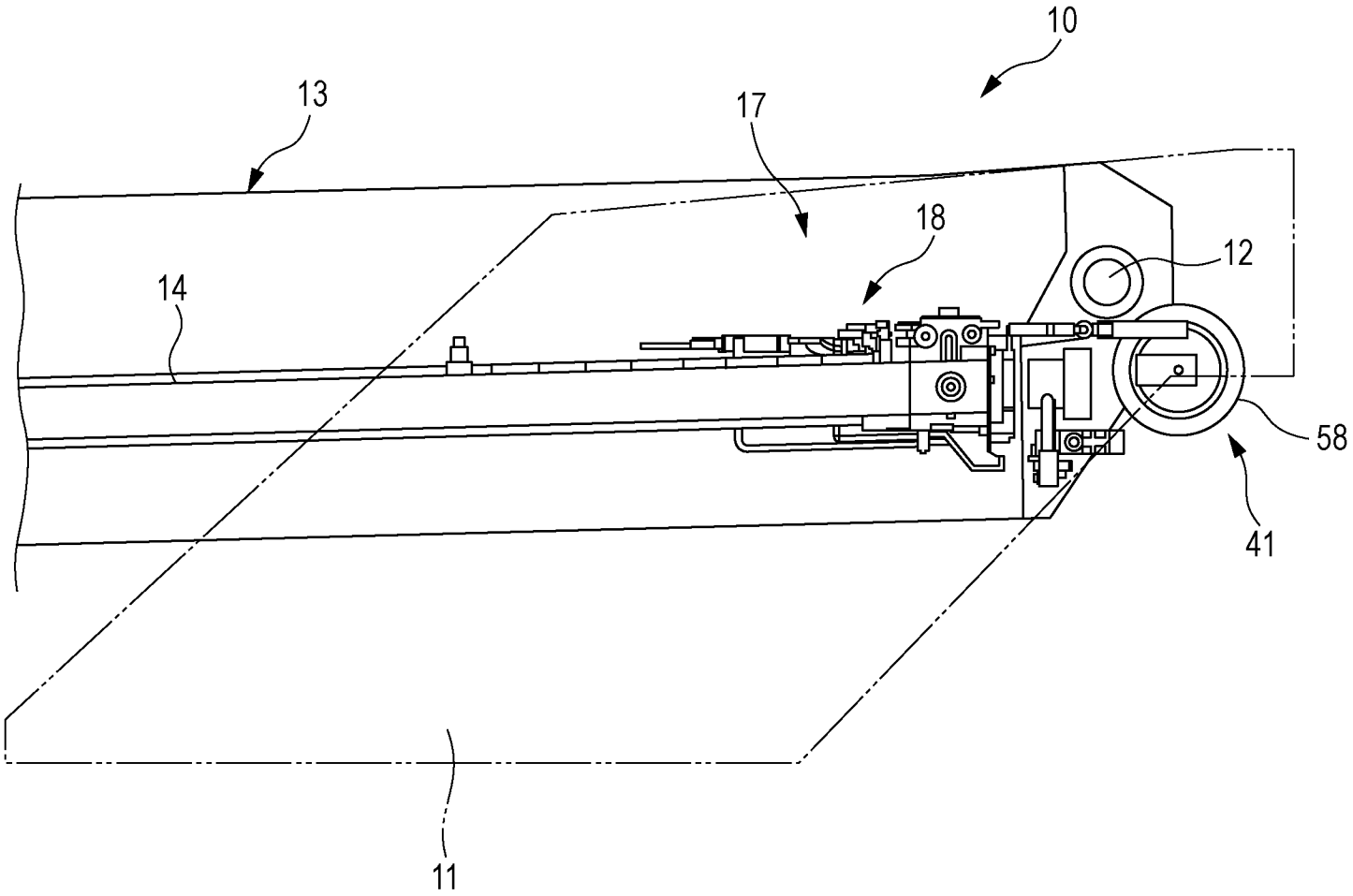
FIG. 1 is an enlarged view of main components of a mobile crane employing a telescopic boom extension device according to an embodiment of the present invention.

FIG. 1 is an enlarged view of main components of a mobile crane (typically, a rough-terrain crane) employing a telescopic boom extension device 10 according to an embodiment of the present invention.

As illustrated in the drawing, the mobile crane includes a turning base 11, and a telescopic boom 13 is supported on the turning base 11 via a derrick central shaft 12. As described hereinafter in detail, the telescopic boom 13 includes a plurality of cylindrical booms that constitute a telescopic structure. The telescopic boom 13 is rotatable around the derrick central shaft 12 and performs a derricking action by extension and retraction of a derrick cylinder not illustrated. A single extension cylinder 14 is mounted in the telescopic boom 13 such that, as the extension cylinder 14 extends and retracts, the telescopic boom 13 extends and retracts longitudinally in a manner described, hereinafter.

Figure 2:
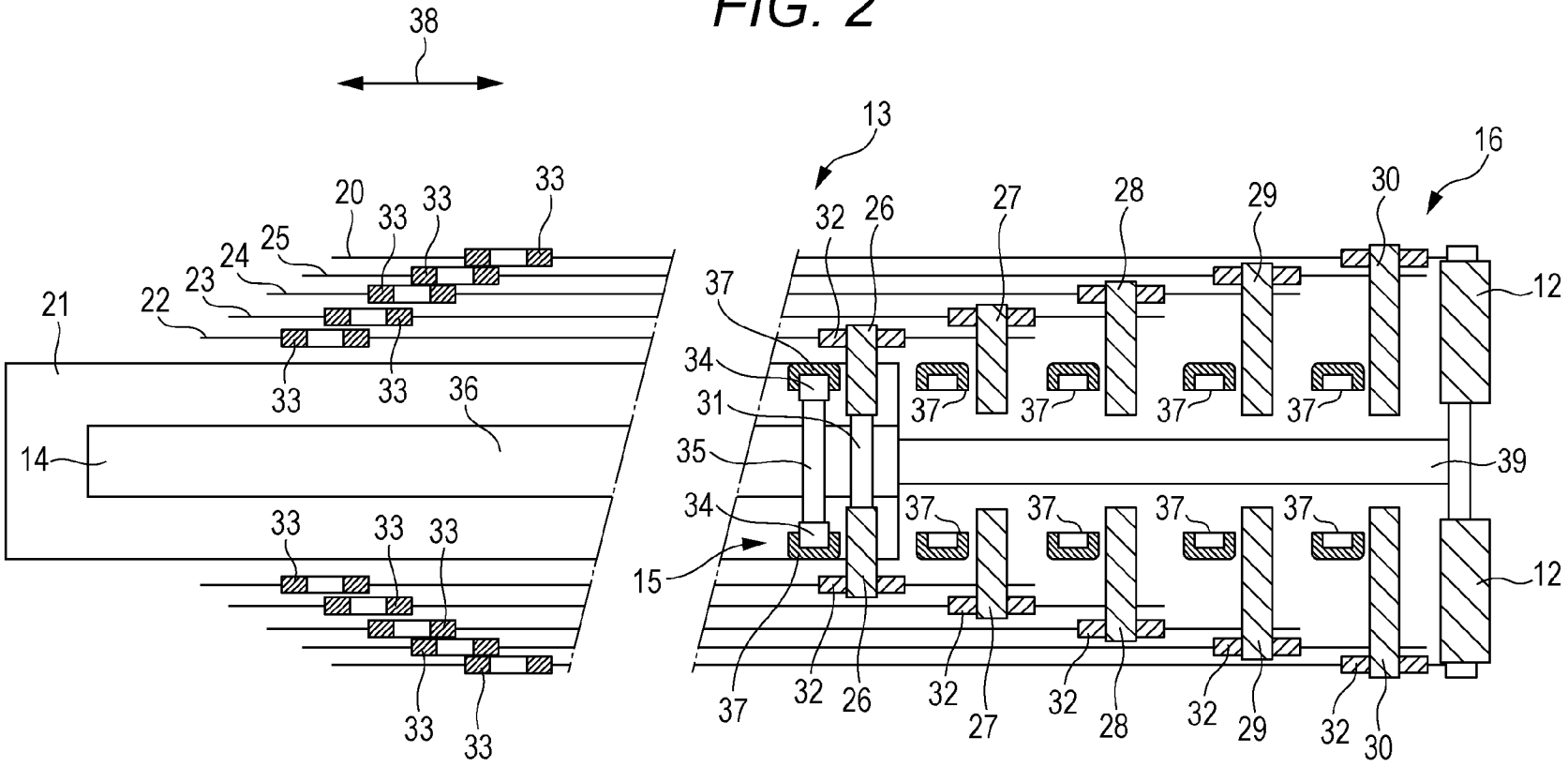
FIG. 2 is a schematic view showing a structure of a telescopic boom according to the embodiment of the present invention.

FIG. 2 is a schematic view showing a structure of the telescopic boom 13 according to the embodiment of the present invention.

As illustrated in FIGS. 1 and 2, a telescopic boom extension device (hereinafter, referred simply to as "extension device") 10 includes: the telescopic boom 13; the extension cylinder 14 that extends and retracts the telescopic boom 13; a cylinder-boom coupling mechanism 15 that couples the extension cylinder 14 to a predetermined part of the telescopic boom 13; an inter-boom fixing mechanism 16 that couples adjacent booms among a plurality of booms constituting the telescopic boom 13; and a driving mechanism 17 (see FIG. 1) that drives the cylinder-boom coupling mechanism 15 and the inter-boom fixing mechanism 16.

Figure 3:
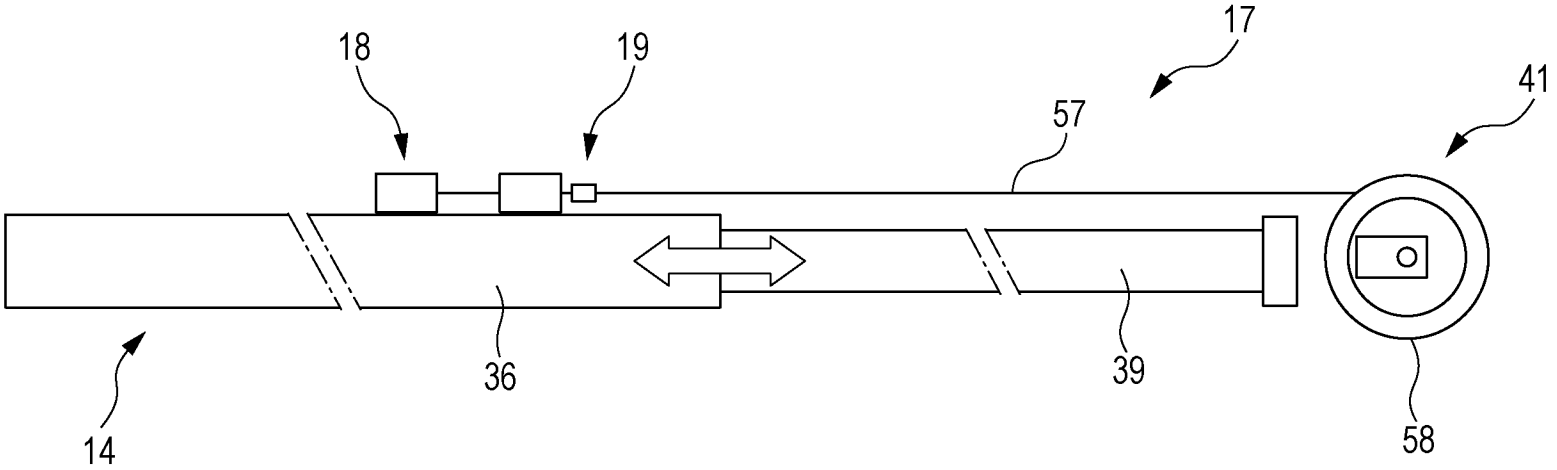
FIG. 3 is a schematic diagram showing a structure of a driving mechanism according to the embodiment of the present invention.

FIG. 3 is a schematic diagram showing a structure of the driving mechanism 17 according to the embodiment of the present invention.

The extension device 10 according to this embodiment is characterized by the structure of the driving mechanism 17. As illustrated in FIGS. 1 and 3, the driving mechanism 17 includes a hydraulic supply part 18 and a drive source generation part 19 to be described hereinafter in detail. The drive source generation part 19 generates a predetermined hydraulic pressure at the hydraulic supply part 18 based on a pneumatic pressure. The hydraulic supply part 18 supplies the hydraulic pressure to the cylinder-boom coupling mechanism 15 and the inter-boom fixing mechanism 16 (see FIG. 2) to activate the same in a manner described hereinafter. The drive source generation part 19 employs a pneumatic supply part 41 described hereinafter to feed compressed air to the hydraulic supply part 18. Specifically, the driving mechanism 17 converts the pneumatic pressure to the hydraulic pressure to drive the cylinder-boom coupling mechanism 15 and the inter-boom fixing mechanism 16. This produces the advantage that the entire driving mechanism 17 can be significantly reduced in weight and size.

<Operations of the Telescopic Boom>

As illustrated in FIG. 2, the telescopic boom 13 includes a base boom 20, a top boom 21, and four intermediate booms 22 to 25 between the base and top booms. The intermediate booms 22 to 25 will be called first, second, third and fourth intermediate booms 22, 23, 24 and 25, respectively, in sequence from the intermediate boom adjacent to the top boom 21. That is, in this embodiment, the telescopic boom 13 has a six-stage structure. The telescopic boom 13 is assembled such that the booms 21 to 25 slide in a longitudinal direction 38 from the base boom 20, thereby constituting a telescopic structure as described above. However, the telescopic boom 13 does not have to be a six-stage telescopic boom, and there is no specific limitation on the number of intermediate booms.

In this embodiment, the single extension cylinder 14 is built in the telescopic boom 13. The extension cylinder 14 is a hydraulic double-acting cylinder, and the leading end portion of a cylinder rod 39 is coupled to the base end of the base boom 20. The extension cylinder 14 is placed along the telescopic boom 13 in the longitudinal direction 38, and a cylinder tube 36 is placed inside the top boom 21 in the state illustrated in FIG. 2. The operation to extend and retract the extension cylinder 14 causes the extension cylinder 14 to extend and retract in a manner described hereinafter.

FIG. 2 illustrates the telescopic boom 13 in the fully-retracted state. In this state, the adjacent booms are constantly coupled together by the inter-boom fixing mechanism 16.

Figure 4:
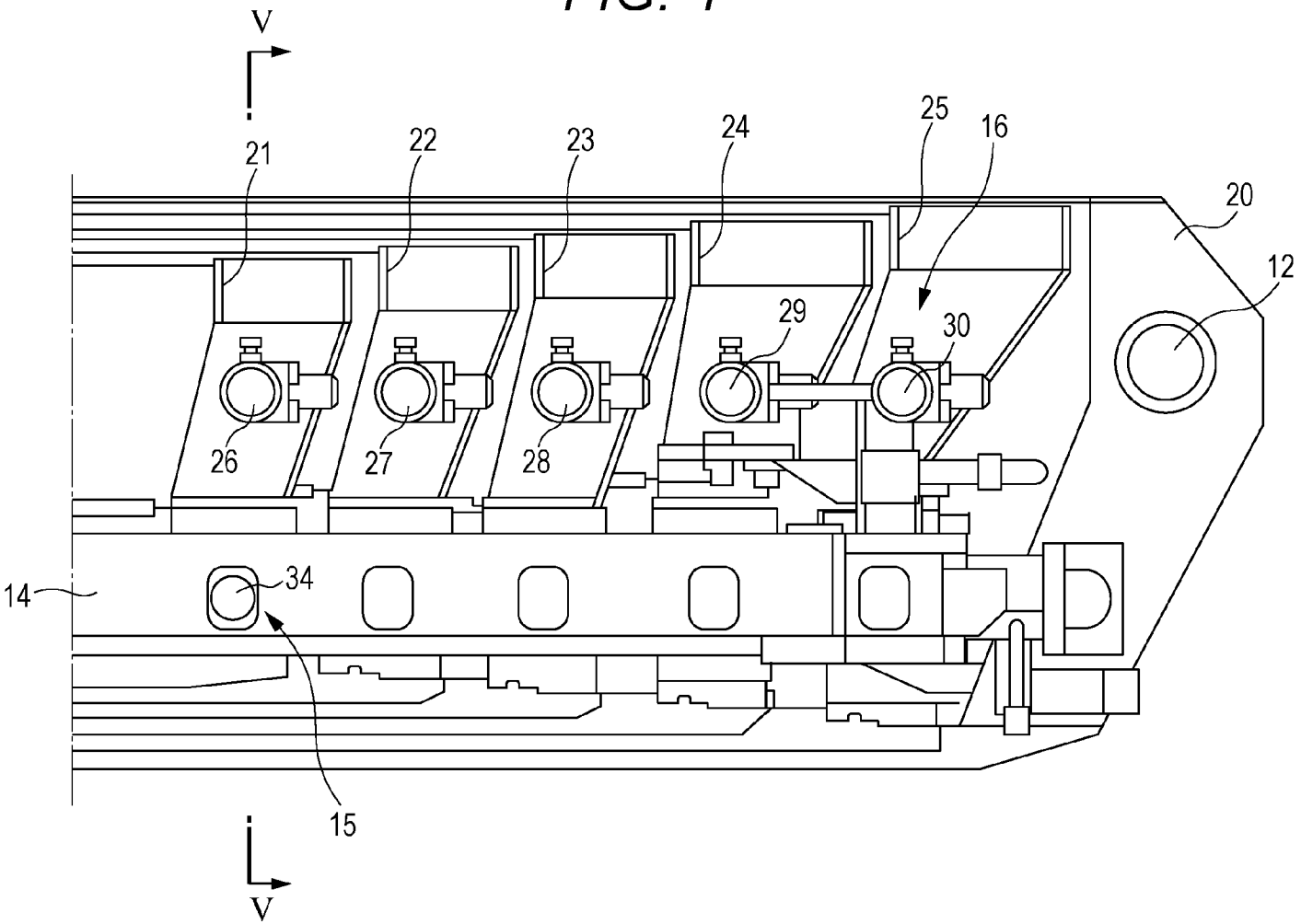
FIG. 4 is a vertical cross-sectional view of the telescopic boom according to the embodiment of the present invention.
Figure 5A:
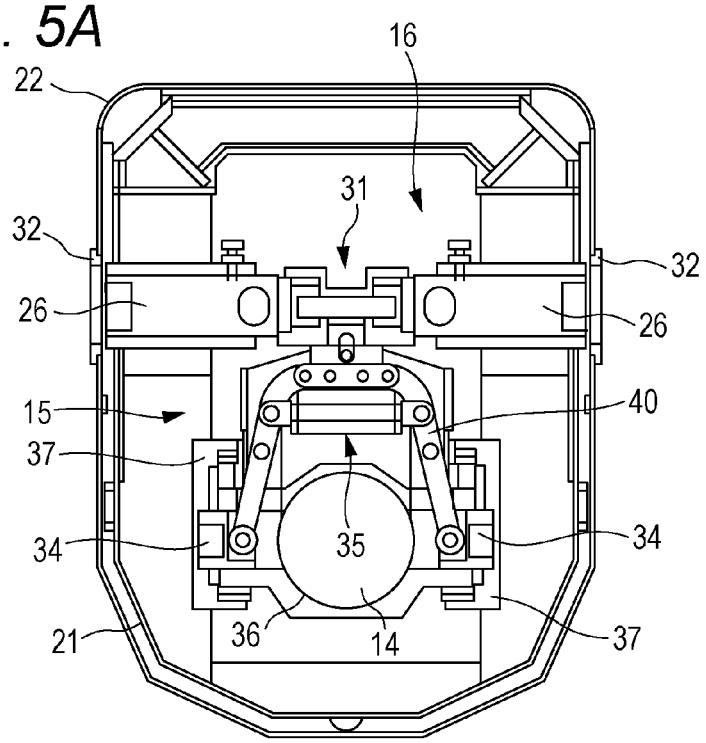
FIGS. 5A and 5B are lateral cross-sectional views of the telescopic boom according to the embodiment of the present invention.
Figure 5B:
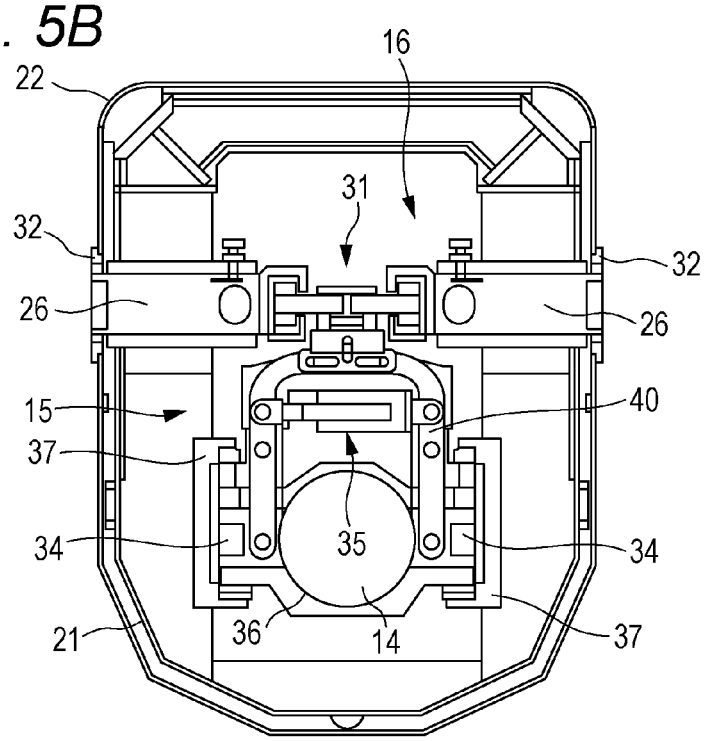

FIG. 4 is a vertical cross-sectional view of the telescopic boom 13, and FIGS. 5A and 5B are lateral cross-sectional views of the same, respectively. FIGS. 5A and 5B are cross-sectional views of the telescopic boom 13 taken along V-V plane in FIG. 4. The drawings show schematically structures of the cylinder-boom coupling mechanism 15 and the inter-boom fixing mechanism 16.

As illustrated in FIGS. 2, 4, and 5A and 5B, the inter-boom fixing mechanism 16 includes five pairs of boom fixing pins (hereinafter, referred to as "B pins") 26 to 30 and a hydraulic cylinder 31 (equivalent to a "second hydraulic actuator" described in the claims) that drives the fixing pins 26 to 30. The structure of the inter-boom fixing mechanism 16 is known. The B pins 26 penetrate through the top boom 21 and first intermediate boom 22 adjacent to each other to regulate the relative sliding of the two booms. As illustrated in FIGS. 2, 5A, and 5B, the B pins 26 are provided on the top boom 21 side and moves forward or backward relative to the first intermediate boom 22 to penetrate through the first intermediate boom 22 or separate from the first intermediate boom 22. In the normal state, the B pins 26 are biased toward the first intermediate boom 22 by a spring not illustrated. The portions of the first intermediate boom 22 through which the B pins 26 penetrate are the base end portion and the leading end portion where bosses 32 and 33 are provided, and the B pins 26 are to be inserted into the bosses 32 and 33 (see FIG. 2). The portions of the first intermediate boom 22 where the bosses 32 or 33 are provided are where the B pins 26 face when the top boom 21 is brought into the fully-retracted state or the fully-extended state relative to the first intermediate boom 22. That is, the top boom 21 and the first intermediate boom 22 are coupled and fixed by the B pin 26 when the top boom 21 is in the fully-contracted state or the fully-extended state relative to the first intermediate boom 22. As illustrated in FIGS. 5A and 5B, when the hydraulic cylinder 31 is activated, the B pins 26 are pulled out of the first intermediate boom 22. Accordingly, the top boom 21 becomes slidable relative to the first intermediate boom 22. The B pins 27 to 30 behave in the same manner as the B pins 26.

As illustrated in FIGS. 2, 4, 5A, and 5B, the cylinder-boom coupling mechanism 15 includes cylinder coupling pins (hereinafter, referred to as "C pins") 34 and a hydraulic cylinder 35 (equivalent to a "first hydraulic actuator" described in the claims) that drives the C pins 34. The structure of the cylinder-boom coupling mechanism 15 is known. The C pins 34 are provided at the cylinder tube 36 side of the extension cylinder 14, and is constantly fitted to the top boom 21 in the state illustrated in FIG. 2. As illustrated in FIGS. 5A and 5B, the hydraulic cylinder 35 includes a link mechanism 40. When the hydraulic cylinder 35 is activated, the link mechanism 40 slides the C pins 34 in the right and left direction in FIGS. 5A and 5B. In the normal state, the C pin 34 is biased toward the top boom 21 by a spring not illustrated. Bosses 37 are provided at the base end portion of the top boom 21, and the C pins 34 are fitted to the bosses 37. When the hydraulic cylinder 35 is activated, the C pins 34 are pulled toward the extension cylinder 14 via the link mechanism 40. When the C pins 34 are pulled out of the bosses 37, the extension cylinder 14 is mechanically separated from the top boom 21. That is, the extension cylinder 14 is coupled to the top boom 21 in the normal state, but the extension cylinder 14 becomes slidable relative to the telescopic boom 13 when the hydraulic cylinder 35 is activated. The bosses 37 are also provided at each of the base end portions of the intermediate booms 22 to 25. The C pin 34 can be selectively coupled to the intermediate booms 22 to 25 in a manner described hereinafter.

FIG. 5A illustrates the state in which the B pins 26 are pulled out of the first intermediate boom 22 and the C pins 34 are coupled to the top boom 21. FIG. 5B illustrates the state in which the B pins 26 are coupled to the first intermediate boom 22 and the C pins 34 are pulled out of the top boom 21.

When the extension cylinder 14 extends in the state of FIG. 5A, the top boom 21 slides together with the cylinder tube 36 of the extension cylinder 14 leftward in the direction of arrow 38 relative to the first intermediate boom 22 as illustrated in FIG. 2. When the extension cylinder 14 extends up to the position of the first intermediate boom 22 where the B pins 26 face the bosses 33, the hydraulic cylinder 31 is deactivated, and the B pins 26 return to the first intermediate boom 22 side because of the spring and fit to the bosses 33. Accordingly, the first intermediate boom 22 and the top boom 21 are fixed to each other while the first intermediate boom 22 is in the fully-extended state relative to the top boom 21. Then, as illustrated in FIG. 5B, the hydraulic cylinder 35 is activated to decouple the C pins 34 from the top boom 21 via the link mechanism 40. That is, the C pins 34 are pulled out of the bosses 37 of the top boom 21. When the extension cylinder 14 retracts in that state, only the cylinder tube 36 moves toward the base end of the base boom 20 (rightward in FIG. 2).

Meanwhile, the hydraulic cylinder 35 remains activated to keep the C pins 34 in the state of FIG. 5B. When the extension cylinder 14 retracts to move the C pins 34 down to the position of the bosses 37 provided at the first intermediate boom 22, the retraction of the extension cylinder 14 is stopped while the hydraulic cylinder 35 is deactivated, and the C pins 34 are coupled to the bosses 37 of the first intermediate boom 22 as illustrated in FIG. 5A. Subsequently, when the first intermediate boom 22 is to be extended, the same action as in the case of the top boom 21 is performed to extend the second intermediate boom 23. Similarly, the second, the third, and the fourth intermediate booms 23, 24, and 25 are extended in sequence. When the telescopic boom 13 is to be retracted, the foregoing actions are reversely performed.

<Drive Circuit of the Extension Device>

Figure 6:
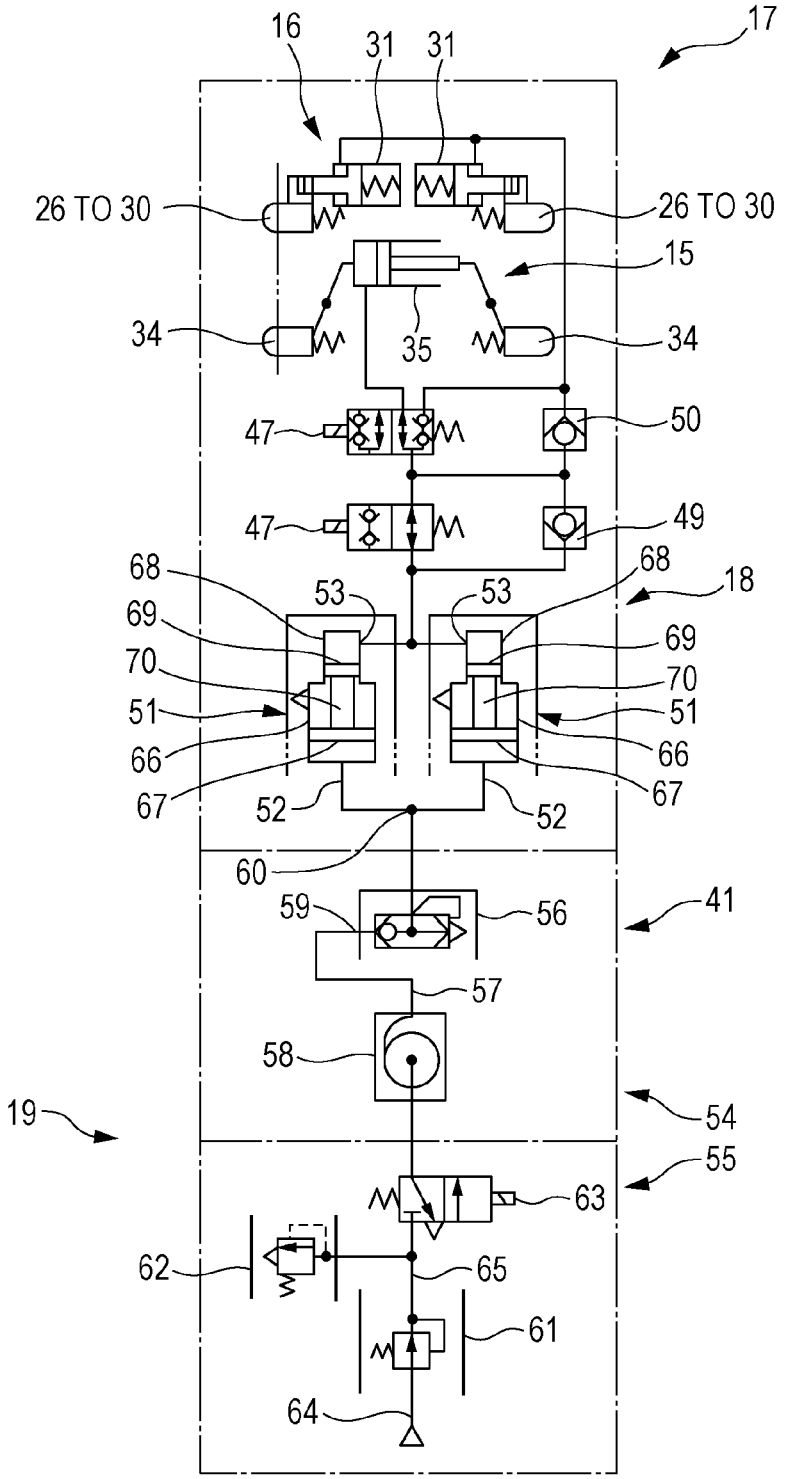
FIG. 6 is a circuit system diagram of the driving mechanism according to the embodiment of the present invention.

FIG. 6 is a circuit system diagram of the driving mechanism 17.

The driving mechanism 17 drives the cylinder-boom coupling mechanism 15 and the inter-boom fixing mechanism 16 as described above. As illustrated in FIG. 6, the driving mechanism 17 according to this embodiment includes the hydraulic supply part 18 and the drive source generation part 19, and the drive source generation part 19 operates with compressed air as a working fluid. That is, the driving mechanism 17 is a hydraulic-pneumatic composite system.

The hydraulic supply part 18 includes electromagnetic switching valves 47 and 48, check valves 49 and 50, and a pair of air over hydraulic boosters (AOHs) 51. These components are connected to the hydraulic cylinders 31 and 35. The boom fixing pins 26 to 30 and the cylinder coupling pins 34 are driven by the hydraulic cylinder 31 and the hydraulic cylinder 35 as described above. The hydraulic supply part 18 constitutes a so-called closed circuit together with the hydraulic cylinders 31 and 35, which is provided at the cylinder tube 36 of the extension cylinder 14. Each of the AOHs 51 has a pneumatic input port 52 and a hydraulic output port 53, and outputs from the hydraulic output port 53 a predetermined hydraulic pressure corresponding to the pneumatic pressure input into the pneumatic input port 52.

In this embodiment, each of the AOHs 51 includes an input cylinder 66 (equivalent to an "air tube" described in the claims), an air piston 67, an output cylinder 68, and a hydraulic piston 69. The pneumatic input port 52 is provided at the input cylinder 66, and the hydraulic output port 53 is provided at the output cylinder 68. The air piston 67 and the hydraulic piston 69 are coupled together by a main shaft 70 and slide in an integrated manner. In this embodiment, the air piston 67 is held in a freely movable state within the input cylinder 66. Specifically, the air piston 67 is held only by frictional force generated between the air piston 67 and the hydraulic piston 69 in the input cylinder 66. That is, the air piston 67 is in the freely movable state and is not biased in any direction within the input cylinder 66. The advantage of the air piston 67 being movable without any biasing force will be described hereinafter.

The drive source generation part 19 includes: a pneumatic supply part 41 including a pneumatic supply unit 54; and a control valve unit 55.

The pneumatic supply unit 54 includes a quick release valve 56, an air hose 57, and a hose reel 58. The quick release valve 56 has an input port 59 and an output port 60. The output port 60 is connected to the pneumatic input ports 52 of the AOHs 51. The air hose 57 is cut into a predetermined length and wound around the hose reel 58 in an unrollable manner. In this embodiment, the hose reel 58 is attached to the back part of the turning base 11 as illustrated in FIGS. 1 and 3. The length of the air hose 57 is set as appropriate, and in this embodiment, the length of the air hose 57 corresponds to the stroke of the extension cylinder 14. The pneumatic supply part 41 includes a pneumatic source not illustrated. The pneumatic source may be an air tank included in the mobile crane, for example. The pressure of the pneumatic source is 1 MPa, for example.

The control valve unit 55 includes pressure control valves (pressure reducing valve 61 and relief valve 62) and an electromagnetic switching valve 63. The pneumatic source is connected to an input port 64 of the pressure reducing valve 61, and the electromagnetic switching valve 63 is connected to an output port 65 of the same. The relief valve 62 is provided between the pressure reducing valve 61 and the electromagnetic switching valve 63.

As described above, to extend the telescopic boom 13, the B pins 26 to 30 and the C pins 34 are operated. This operation is performed in a manner described below.

When the top boom 21 extends in the state of FIG. 2, the drive source generation part 19 feeds compressed air to the hydraulic supply part 18. Specifically, the electromagnetic switching valve 63 is switched (the symbols are switched in FIG. 6) to feed the compressed air to the air hose 57. The air hose 57 is wound around the hose reel 58, but the compressed air is sent through the air hose 57 to the quick release valve 56. The compressed air activates the quick release valve 56 and reaches the AOHs 51.

The electromagnetic switching valves 47 and 48 are switched together with the electromagnetic switching valve 63 (the symbols are exchanged in FIG. 6). With a supply of compressed air, each of the AOHs 51 generates a predetermined hydraulic pressure (for example, 10 MPa). That is, each of the AOHs 51 feeds a high-pressure operating oil from the hydraulic output port 53. The operating oil is supplied to the hydraulic cylinder 31 through the check valve 49 and the electromagnetic switching valve 48. The hydraulic cylinder 31 operates to remove the B pins 26 from the first boom 22. At this point in time, the excitation of the electromagnetic switching valve 63 is canceled (the symbol returns to the state illustrated in FIG. 6), and the supply of the compressed air is shut off. Even when the supply of the compressed air is shut off as described above, the electromagnetic switching valve 47 and the check valve 49 keep the pressure in the hydraulic cylinder 31. As the extension cylinder 14 extends in this state, the top boom 21 extends.

When the top boom 21 is in the fully-extended state, the extension cylinder 14 stops. Accordingly, the excitation of the electromagnetic switching valves 47 and 48 is canceled (the symbols return to the states illustrated in FIG. 6). Thus, the operating oil supplied to the hydraulic cylinder 31 returns to the output cylinders 68 of the AOHs 51 through the check valve 50 and the electromagnetic switching valve 47. The B pins 26 fit to the bosses 33 to couple again the top boom 21 and the first intermediate boom 22.

As described above, the air pistons 67 of the AOHs 51 are held in the freely movable state within the input cylinders 66. Thus, when the operating oil returns to the output cylinders 68, the hydraulic pistons 69 and the air pistons 67 slide together. The air in the air pistons 67 is fed to the quick release valve 56 and is discharged (released to the atmosphere) from the quick release valve 56.

Subsequently, the electromagnetic switching valve 63 is switched (the symbol is switched in FIG. 6), and the compressed air is fed to the air hose 57. That is, the compressed air is fed from the drive source generation part 19 to the hydraulic supply part 18. In the same manner as described above, the compressed air is fed through the air hose 57 to the quick release valve 56 and reaches the AOHs 51. The AOHs 51 feed the operating oil under a predetermined pressure from the hydraulic output ports 53.

The electromagnetic switching valve 63 and the electromagnetic switching valve 47 are switched (the symbols are switched in the drawing). The operating oil is supplied to the hydraulic cylinder 35 through the check valve 49 and the electromagnetic switching valve 48. The hydraulic cylinder 35 operates to remove the C pins 34 from the top boom 21. At this point in time, the excitation of the electromagnetic switching valve 63 is canceled and the supply of the compressed air is shut off. Even when the supply of the compressed air is shut off as described above, the electromagnetic switching valve 47 and the check valve 49 keep the pressure in the hydraulic cylinder 35. In this state, as the extension cylinder 14 retracts (see FIG. 2), the top boom 21 remains held in the fully-extended state by the first intermediate boom 22, and only the cylinder tube 36 slides toward the base end portion of the first intermediate boom 22.

When the extension cylinder 14 retracts and the C pins 34 move to the position of the bosses 37 of the first intermediate boom 22, the extension cylinder 14 stops. Accordingly, the excitation of the electromagnetic switching valve 47 is cancelled. The operating oil supplied to the hydraulic cylinder 35 returns to the output cylinders 68 of the AOHs 51 through the electromagnetic switching valves 48 and 47. As a result, the C pins 34 fit to the bosses 37 and the extension cylinder 14 is coupled to the first intermediate boom 22. When the operating oil returns to the output cylinder 68, the air pistons 67 of the AOHs 51 are held in the freely movable state within the input cylinders 66, and the hydraulic pistons 69 and the air pistons 67 slide together. The air in the air pistons 67 is fed to the quick release valve 56 and is discharged (released to the atmosphere) from the quick release valve 56.

In the same manner, the second to fourth intermediate booms 23 to 25 are extended. In addition, as the extension cylinder 14 retracts, the hydraulic supply part 18 and the drive source generation part 19 operate in the same manner. In this embodiment, since the control valve unit 55 includes the pressure control valves (pressure reducing valve 61 and relief valve 62), the compressed air under an appropriate pressure according to the load is supplied from the pneumatic source to the drive source generation part 19.

Figure 7:
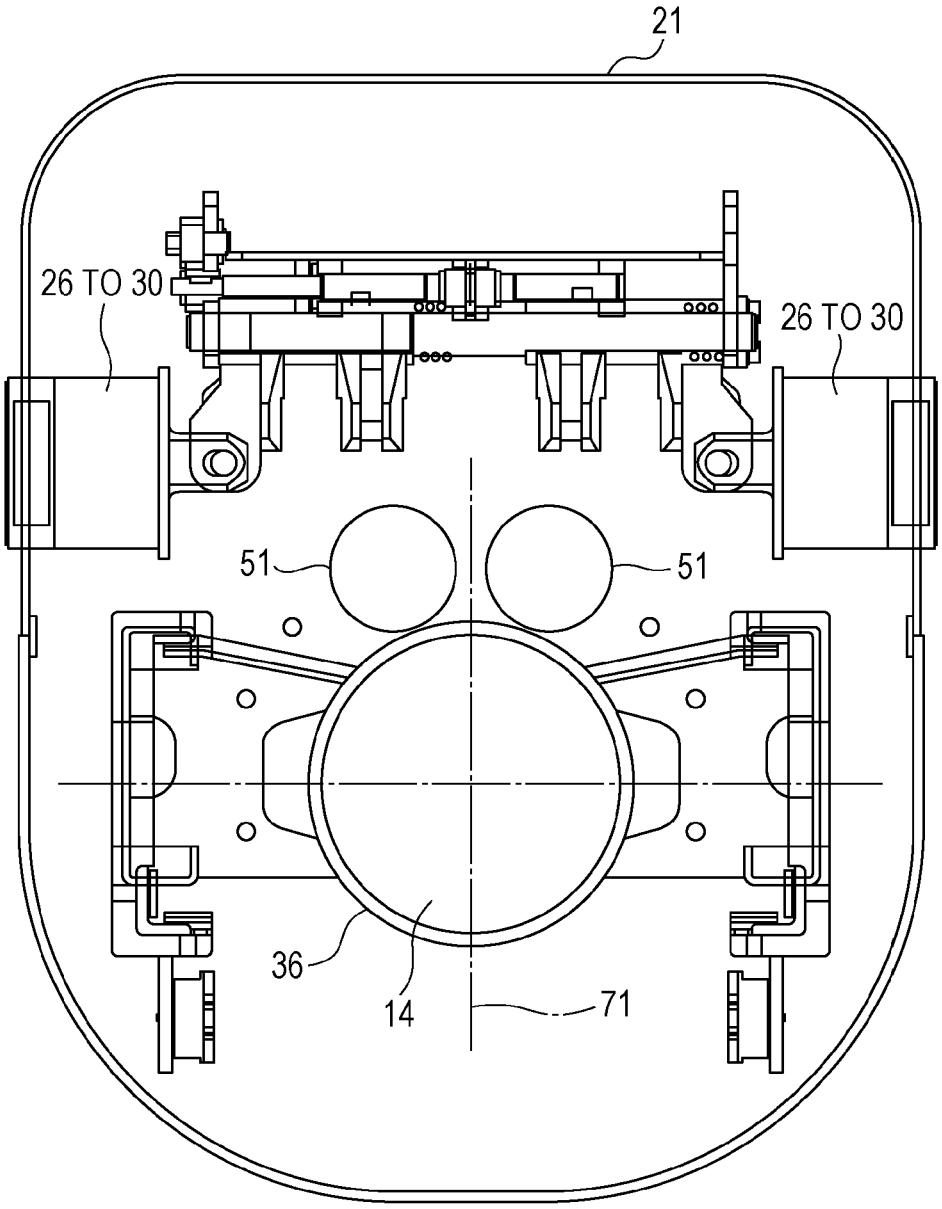
FIG. 7 is a cross-sectional view of a top boom according to the embodiment of the present invention.

FIG. 7 is a cross-sectional view of the top boom 21.

In this embodiment, the hydraulic supply part 18 includes the two AOHs 51. The AOHs 51 are arranged in the vicinity of the cylinder tube 36 of the extension cylinder 14 as illustrated in FIG. 7. These AOHs 51 are radially symmetric (bilaterally symmetric in FIG. 7) with respect to a virtual plane 71 including the center axis of the extension cylinder 14. The operational advantage of arranging the two AOHs 51 symmetrically will be described hereinafter.

<Operations and Effects of the Extension Device According to This Embodiment>

According to the extension device 10 in this embodiment, since the hydraulic supply part 18 is provided at the cylinder tube 36 of the extension cylinder 14, the distance between the hydraulic supply part 18 and the hydraulic cylinders 31 and 35 is very short. That is, the circuit length in the hydraulic system of the driving mechanism 17 is much shorter than the related art, and the operational responsiveness of the cylinder-boom coupling mechanism 15 and the inter-boom fixing mechanism 16 do not decrease significantly with variations in the viscosity of the operating oil. In addition, the hydraulic supply part 18 generates a predetermined hydraulic pressure based on the compressed air supplied from the drive source generation part 19. Thus, even in a case where the circuit length is long in the pneumatic system of the driving mechanism 17 as in this embodiment, the pressure loss of the air with changes in environmental temperature is small. The operational responsiveness of the cylinder-boom coupling mechanism 15 and the inter-boom fixing mechanism 16 is not affected even in this case.

Therefore, the pneumatic supply part 41 in this embodiment does not need to be increased in size taking into account the pressure loss of the air but can be designed to be lightweight and small. That is, the air hose 57 can be decreased in diameter and the hose reel 58 can be designed to be compact, and thus they can be significantly small in weight as compared to the related art. As a result, the space for placement of auxiliary devices at the periphery of the turning base 11 can be wider to improve the degree of freedom in layout of the hose reel 58. In particular, as illustrated in FIG. 1, the hose reel 58 can be arranged above the turning base 11, for example, in the vicinity of the derrick central shaft 12 included in the telescopic boom 13.

In this embodiment, since the hydraulic supply part 18 includes the AOHs 51, the pressure in the pneumatic source is kept small, whereas the pressure of the operating oil supplied to the hydraulic cylinders 31 and 35 becomes large. That is, the hydraulic pressure necessary for operating the hydraulic cylinders 31 and 35 can be easily obtained.

In this embodiment, the pair of AOHs 51 is provided. Accordingly, the load on each of the AOHs 51 to generate the necessary hydraulic pressure is reduced, and the AOHs 51 can be made compact and laid out between the cylinder tube 36 and the inner wall of the top boom 21 as in this embodiment. In addition, the AOHs 51 are arranged symmetrically with respect to the cylinder tube 36 to produce the advantage that the weight distribution in the telescopic boom 13 is uniform.

In particular, in this embodiment, the AOHs 51 constitute a closed circuit as a hydraulic circuit, and the air pistons 67 of the AOHs 51 are arranged in the freely movable state within the input cylinders 66. For example, when the pressure of the operating oil in the hydraulic supply part 18 increases with a change in environmental temperature, since the air pistons 67 are in the freely movable state, the hydraulic pistons pairing with the air pistons 67 are easily displaced. That is, arranging the air pistons 67 in the freely movable state achieves the same function as the case where the output cylinders 68 are provided with reservoir tanks. Therefore, there is no need to provide separate reservoir tanks in the AOHs 51. As a result, it is possible to simplify the structure of the AOHs 51 and reduce the size and weight of the hydraulic supply part 18.

<Variation of This Embodiment>

In this embodiment, the pair of AOHs 51 is employed. Alternatively, a single AOH may be employed. In addition, the air tank included in the pneumatic supply part 41 also acts as a brake air tank. Alternatively, separate air tanks or other pneumatic sources may be provided for the AOHs 51. In this embodiment, the pressure of the compressed air supplied to the pneumatic supply unit 54 is set to 1 MPa, but is not limited to this value. The pressure of the pneumatic source can be set as appropriate as far as the outputs of the AOHs 51 are 10 MPa.

What is claimed is:

1. A telescopic boom extension device comprising:

a telescopic boom that includes a base boom, an intermediate boom inserted into the base boom, and a top boom inserted into the intermediate boom, one of the booms adjacent to each other being placed slidably relative to the other boom;

a single extension cylinder that includes a cylinder tube and a cylinder rod and that is built into the telescopic boom along a longitudinal direction of the booms while the cylinder rod is coupled to the base boom;

a cylinder-boom coupling mechanism that includes a first hydraulic actuator configured to engage selectively with the top boom or the intermediate boom to couple the engaged boom to the cylinder tube;

an inter-boom fixing mechanism that includes a second hydraulic actuator configured to couple the adjacent booms to regulate relative sliding of the booms and to decouple specific coupled booms when necessary; and a driving mechanism configured to drive the cylinder-boom coupling mechanism and the inter-boom fixing mechanism, wherein the driving mechanism includes:

a hydraulic supply part that is provided at the cylinder tube and includes an air over hydraulic booster (AOH) connected to both the first hydraulic actuator and the second hydraulic actuator, as a source of operating oil to the first hydraulic actuator and the second hydraulic actuator; and a drive source generation part that includes a pneumatic hose configured to connect a pneumatic source and the AOH and that is configured to generate the operating oil under a predetermined pressure at the hydraulic supply part based on the pneumatic pressure from the pneumatic source.

2. The telescopic boom extension device according to claim 1, wherein the hydraulic supply part includes a pair of the AOHs arranged symmetrically with respect to the cylinder tube.

3. The telescopic boom extension device according to claim 1, wherein the drive source generation part includes a hose reel.

4. The telescopic boom extension device according to claim 1, wherein the AOH includes an air cylinder including an air piston and an air tube, wherein the air piston is slidable relative to the air tube without being biased in any direction.

* * * * *